US008424246B2

(12) United States Patent
Feng et al.

(10) Patent No.: US 8,424,246 B2
(45) Date of Patent: Apr. 23, 2013

(54) ANTI-FALL DEVICE FOR A WINDOW SASH

(75) Inventors: Lin Feng, Shenzhen (CN); Lokshun Leung, Hong Kong (CN)

(73) Assignee: Lin Feng, Shenzhen, Guangdong Province (CN)

( * ) Notice: Subject to any disclaimer, the term of this patent is extended or adjusted under 35 U.S.C. 154(b) by 181 days.

(21) Appl. No.: 12/738,837

(22) PCT Filed: Nov. 5, 2007

(86) PCT No.: PCT/CN2007/003130

§ 371 (c)(1), (2), (4) Date: Jul. 13, 2010

(87) PCT Pub. No.: WO2009/049444

PCT Pub. Date: Apr. 23, 2009

(65) Prior Publication Data

US 2010/0275516 A1 Nov. 4, 2010

(30) Foreign Application Priority Data

Oct. 19, 2007 (CN) ..... 2007 1 0123973

(51) Int. Cl.
*E05D 13/00* (2006.01)

(52) U.S. Cl.
USPC ..... 49/322; 52/712

(58) Field of Classification Search ..... 49/322, 49/70, 507; 52/712
See application file for complete search history.

(56) References Cited

U.S. PATENT DOCUMENTS

| | | | | |
|---|---|---|---|---|
| 1,286,618 | A * | 12/1918 | Heinz | 193/34 |
| 3,355,695 | A * | 11/1967 | Overesch | 439/31 |
| 3,609,293 | A * | 9/1971 | Stewart et al. | 219/200 |
| 3,673,735 | A * | 7/1972 | Winsler et al. | 49/70 |
| 6,564,512 | B1 * | 5/2003 | Whittemore | 52/37 |
| 2004/0055218 | A1 * | 3/2004 | Forsyth et al. | 49/54 |
| 2011/0078964 | A1 * | 4/2011 | Pardue et al. | 52/202 |
| 2011/0296761 | A1 * | 12/2011 | Wood et al. | 49/70 |

FOREIGN PATENT DOCUMENTS

DE EP 2159360 * 8/2008

* cited by examiner

*Primary Examiner* — Jerry Redman

(57) ABSTRACT

An anti-fall device for a window sash comprises a window-sash fixing block, a window-frame fixing block, an elastic metal wire and a pipe. The elastic metal wire connects the window-sash fixing block and the window-frame fixing block. The window-sash fixing block is defined with a through hole into which the pipe is inserted. One end of the elastic metal wire is connected to the window-frame fixing block, and the other end of the elastic metal wire penetrates the through hole in the window-sash fixing block and enters the pipe. The end of the elastic metal wire, which penetrates the through hole, is fixed with a limiting block. The diameter of the limiting block is bigger than that of the through hole. The window-sash fixing block is fixed on the window sash, and the window-frame fixing block is fixed on the window frame.

6 Claims, 3 Drawing Sheets

ANTI-FALL DEVICE FOR A WINDOW SASH

BACKGROUND OF THE INVENTION

1. Field of the Invention

The present invention relates to a casement window, and more particularly to an anti-fall device for a window sash of a casement window.

2. Description of the Prior Art

Commonly, a casement window consists of a window frame and a window sash. The window sash is connected to the window frame by hinge or linkage rod structure, so that after a long time of use, the connecting parts will rust or loose to fall off, thus causing the window sash to fall off. Therefore, such a casement window has the disadvantage such as low safety.

In order to solve the above problem, conventionally, a chain or a steel cord is provided to connect the window frame and the window sash, so that if the window sash releases from the window frame, the chain or the steel cord can pull the window sash for avoiding the fall-off of the window sash, thus improving the safety. However, such a connecting structure such as the chain or the steel cord is directly exposed, so it suffers from the disadvantages such as lack of aesthetic feeling, obstructing the opening of the window sash, easy to rust and rupture, etc.

SUMMARY OF THE INVENTION

The primary objective of the present invention is to provide an anti-fall device for a window sash, which is embedded type, when the window sash is closed, the steel cord which connects the window frame and the window sash will enter the pipe, and the whole device will hide between the window frame and the window sash. When the window sash is opened, the steel cord will be pulled out of the pipe with the window sash, thus solving the problems caused by the exposed chain or the steel cord.

In order to achieve the above objective, the anti-fall device for a window sash in accordance with the present invention is connected between the window sash and the window frame and comprises a window-sash fixing block, a window-frame fixing block, an elastic metal wire, and a pipe. The elastic metal wire connects the window-sash fixing block and the window-frame fixing block, the window-sash fixing block is defined with a through hole into which the pipe is inserted, one end of the metal wire is fixed to the window-frame fixing block, and the other end of the metal wire is inserted into the pipe through the through hole of the window-sash fixing block and fixed with a limiting block, the limiting block has a diameter greater than a diameter of the through hole.

The window-sash fixing block is fixed on the window sash, and the window-frame fixing block is fixed on the window frame.

The window-sash fixing block is defined with the through hole into which one end of the pipe is inserted, and the other end of the pipe is fixed on the window sash.

The window-sash fixing block is defined with the through hole, which is formed with an expanded end, a diameter of the expanded end is bigger than that of the through hole in the window-sash fixing block, and the pipe is inserted into the expanded end.

The elastic metal wire is a steel cord or a steel wire.

The present invention has the following advantages: high safety, simple structure, low cost, convenient to install and use, etc.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
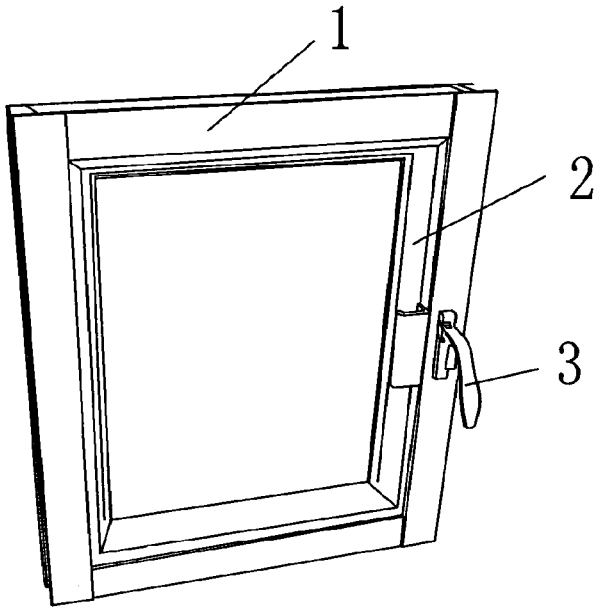
FIG. 1 is a perspective view of a casement window in accordance with the present invention.
Figure 2:
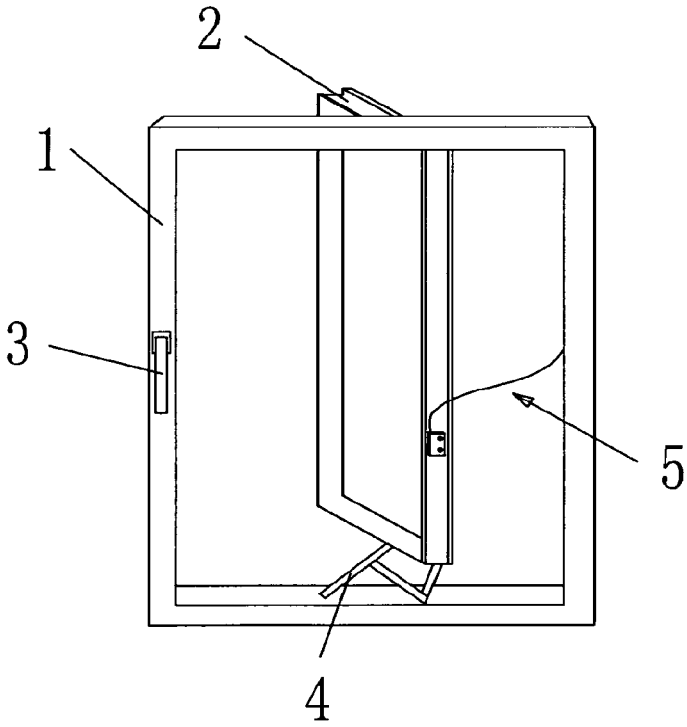
FIG. 2 is a perspective view illustrating the open state of the casement window of FIG. 1 in accordance with the present invention.
Figure 3:
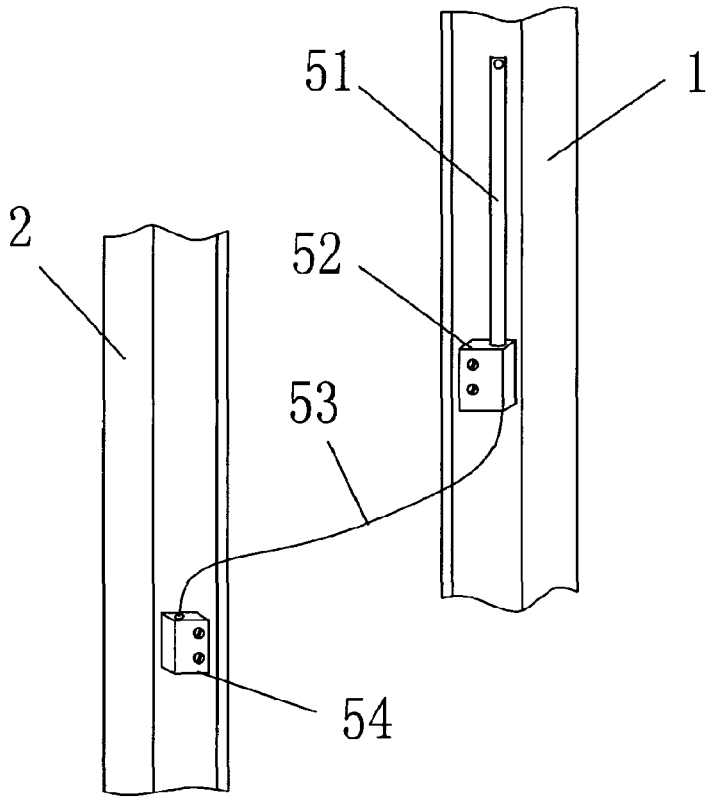
FIG. 3 is a partial view of FIG. 2, illustrating that the structure and the installation sate of the connecting device in accordance with the present invention.
Figures 4, 5:
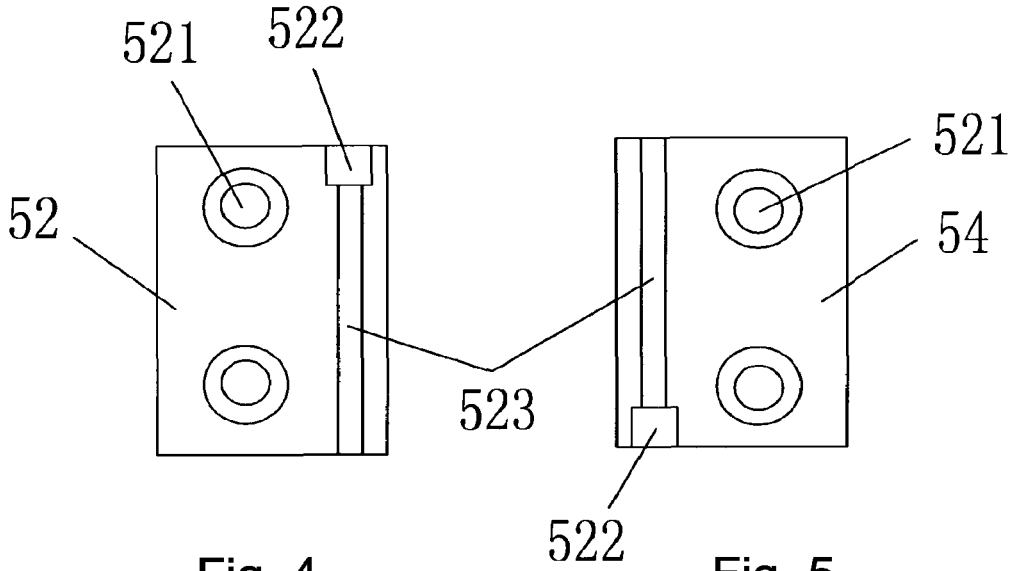
FIG. 4 is a schematic view of a window-frame fixing block of FIG. 3 in accordance with the present invention.
FIG. 5 is a schematic view of a window-sash fixing block of FIG. 3 in accordance with the present invention.
Figure 6:
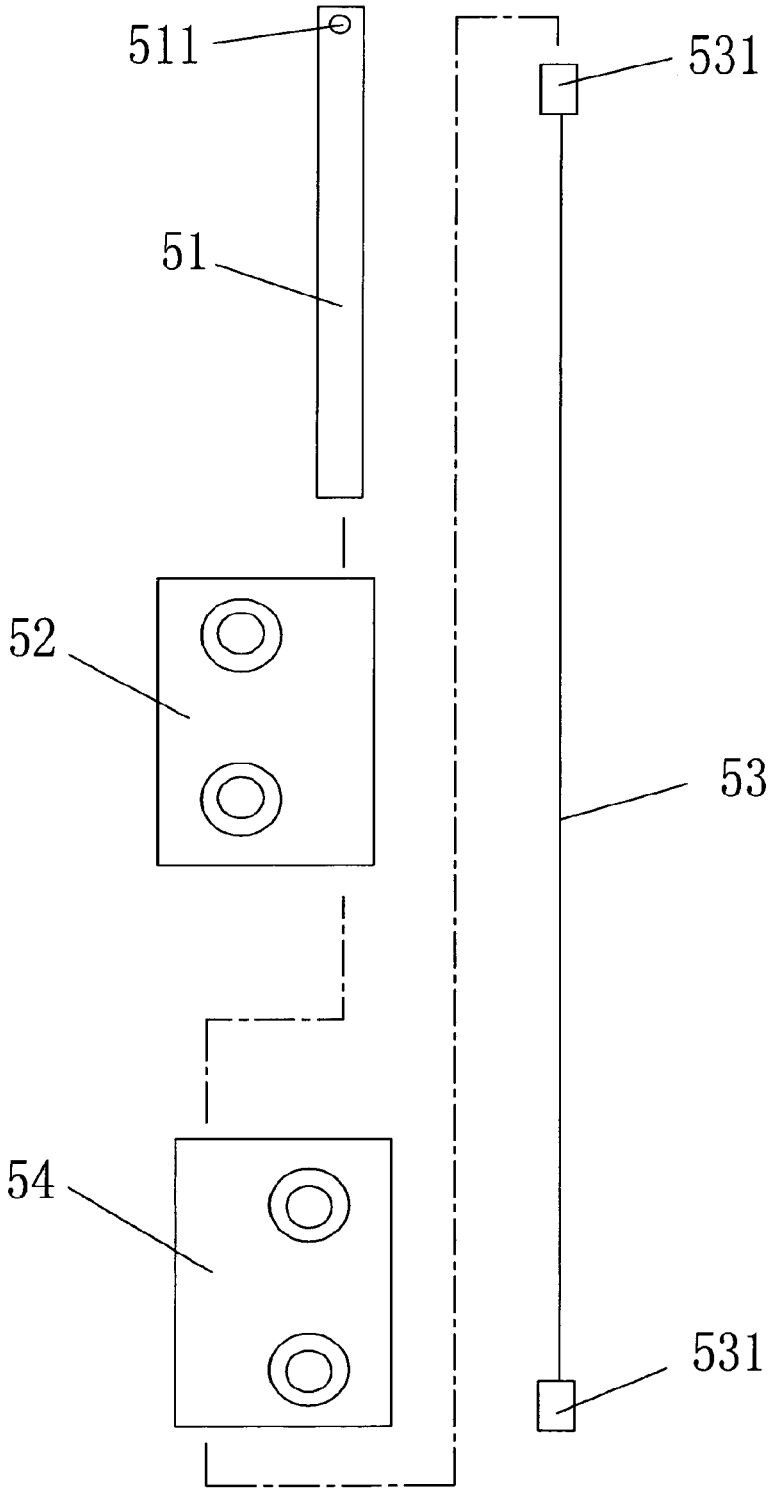
FIG. 6 is an exploded view of the anti-fall device for a window sash in accordance with the present invention.

Referring to FIGS. 1-6, an anti-fall device 5 for a window sash in accordance with the present invention comprises a window-frame fixing block (made of metal) 52, a window-sash fixing block (made of metal) 54, a pipe 51, a steel cord 53.

The window-frame fixing block 52 and the window-sash fixing block 54 each are defined with a through hole 523 in the same direction. Each of the through holes 523 is defined with an expanded end 522. In addition, the window-frame fixing block 52 and the window-sash fixing block 54 each are defined with two screw holes 521. The screw holes 521 are located in the middle of each of the blocks 52, 54, and the through hole 523 is located close to one side of each of the blocks 52, 54. The length of the steel cord 53 is determined according to the opening degree of the window sash 2. The steel cord 53 is inserted through the through holes 523 of the window-frame fixing block 52 and the window-sash fixing block 54, and then both ends of the steel cord 53 will be fixed to two limiting blocks 531 which are engaged in the expanded ends 522 of the through holes 523. The opening of the expanded end 522 in the window-sash fixing block 54 will be sealed to retain the limiting block 531 therein, and the pipe 51 is inserted in the expanded end 522 in the window-frame fixing block 52. The upper end of the pipe 51 is flatly sealed and defined with a fixing hole 511. The window-frame fixing block 52 is fixed on the window frame 1 by screw to fix the pipe 51 on the window frame 1 synchronously, and the window-sash fixing block 54 is fixed on the window sash 2. At this moment, the steel cord 53 will connect the window frame 1 with the window sash 2. In order to connect the fixing blocks 52, 54 to the window frame 1 and the window sash 2 firmly, the other side of each of the window frame 1 and the window sash 2 is further provided with a clamping board in such a manner that the clamping boards and the fixing blocks 52, 54 can clamp both sides of the window frame 1 and the window sash 2. Alternatively, the window-frame fixing block 52 can also be fixed on the wind sash 2, and the window-sash fixing block 54 and the pipe 51 can also be fixed on the window frame 1.

The steel cord 53 can also be substituted by other materials that have a certain strength and elasticity.

When the window sash is closed, the upper end of the steel cord enters and hides in the pipe. When the window sash is opened, the steel cord is pulled out of the pipe, so that once the window sash falls off, the limiting block at the end of the steel cord will be blocked in the through hole in the window-frame fixing block to pull the window sash, thus preventing the window sash from falling off.

While we have shown and described various embodiments in accordance with the present invention, it is clear to those skilled in the art that further embodiments may be made without departing from the scope of the present invention.

What is claimed is:

1. An anti-fall device for a window sash being connected between a window sash and a window frame and comprising a window-sash fixing block, a window-frame fixing block, an elastic metal wire, and a pipe, characterized in that the elastic metal wire connects the window-sash fixing block and the window-frame fixing block, the window-sash fixing block is defined with a through hole, the pipe is inserted in the through hole in the window-sash fixing block, one end of the metal wire is fixed to the window-frame fixing block, and the other end of the metal wire is inserted into the pipe through the through hole of the window-sash fixing block and fixed with a limiting block, the limiting block has a diameter greater than a diameter of the through hole, wherein when the window sash is closed, the upper end of the steel cord enters and hides in the pipe, when the window sash is opened, the metal wire is pulled out of the pipe.

2. The anti-fall device for a window sash as claimed in claim 1, characterized in that the window-sash fixing block is fixed on the window sash, and the window-frame fixing block is fixed on the window frame.

3. The anti-fall device for a window sash as claimed in claim 1, characterized in that the window-sash fixing block is defined with the through hole into which one end of the pipe is inserted, and the other end of the pipe is fixed on the window sash.

4. The anti-fall device for a window sash as claimed in claim 1, characterized in that the window-sash fixing block is defined with the through hole, which is formed with an expanded end, a diameter of the expanded end is bigger than that of the through hole in the window-sash fixing block, and the pipe is inserted into the expanded end.

5. The anti-fall device for a window sash as claimed in claim 1, characterized in that the elastic metal wire is a steel cord.

6. The anti-fall device for a window sash as claimed in claim 1, characterized in that the elastic metal wire is a steel wire.

* * * * *